United States Patent [19]

Larson

[11] Patent Number: 4,899,077

[45] Date of Patent: Feb. 6, 1990

[54] SELF-SERVICE DISPENSING CABINET

[75] Inventor: Sherman L. Larson, Palmyra, N.J.

[73] Assignee: Sherman Industries, Inc., Palmyra, N.J.

[21] Appl. No.: 300,269

[22] Filed: Jan. 23, 1989

[51] Int. Cl.[4] ..... A47B 88/00

[52] U.S. Cl. ..... 312/325; 312/324

[58] Field of Search ..... 312/324, 325, 216

[56] References Cited

U.S. PATENT DOCUMENTS

| | | | |
|---|---|---|---|
| 1,129,389 | 2/1915 | Heller | 312/325 X |
| 1,276,233 | 8/1918 | Likly | 312/216 |
| 1,360,376 | 11/1920 | Douthit | 312/325 X |
| 2,019,054 | 10/1935 | Manz | 312/325 X |

*Primary Examiner*—Joseph Falk

*Attorney, Agent, or Firm*—Ratner & Prestia

[57] ABSTRACT

A self-service product dispensing pivotable cabinet has an open face which is faced forwardly for product dispensing and rearwardly for product restocking. A trigger plunger projects forwardly from the open face of the cabinet through a hole in a fixed faceplate. Pivotal support means for the cabinet include two pivot axis, a first of which comprises a vertical hinge rod mounted on the fixed faceplate for pivotal movement about its own axis. A pair of hinge arms extend horizontally from the vertical rod, one from its upper and the other from its lower end. The second pivot axis comprises an imaginary vertical axis extending between a pair of vertically aligned pivot posts, one each on the top and bottom surfaces of the cabinet, and located at the centers of the surfaces. Each pivot post is received within a recess at the distal end of one of the horizontal hinge arms. The length of the hinge arms and the pivotal movement of the hinge rod allow the cabinet to be initially moved rearwardly along a substantially straight line to effect withdrawal of the trigger plunger from the hole in the fixed faceplate, and then to be moved pivotally through at least 180° to cause the open face to face rearwardly. After restocking, the cabinet is pivoted in the opposite direction and then pushed forwardly along a substantially straight line to cause the head of the trigger plunger to enter and pass through the hole in the fixed faceplate.

2 Claims, 3 Drawing Sheets

SELF-SERVICE DISPENSING CABINET

FIELD OF THE INVENTION

This invention relates to an improvement in self-service, coin-operated dispensers of retail packaged products, such as soap powder, towels, and the like, from a supply cabinet. This type of dispenser, which is referred to in the trade as a vendor cabinet, is frequently found in self-service laundry centers, self-service car wash centers, and the like, but the invention is not limited to such uses. Vendor cabinets are of two types, namely front load and rear load, according to whether the attendant stands at the front or at the rear of the cabinet to reload.

BACKGROUND OF THE INVENTION

In prior art wall-mounted or floor-mounted vendor cabinets, the customer, after selection of the product and insertion of the necessary coin or coins, pulls out and then pushes in a plunger to trigger the release and discharge of the packaged product into a dispensing trough. In some prior and front load vendor cabinets, the front face of the cabinet is pivotal on hinges and to restock the cabinet the attendant merely swings open the front face. In the past, this type has been converted to a rear load vendor cabinet by making the front face fixed, and mounting the remainder of the cabinet on a piano hinge positioned at a vertical corner of the fixed faceplate so that the cabinet can be swung pivotally through 180° , or a substantial portion of 180° . The open front of the cabinet will then face rearwardly, or at least almost rearwardly, for restocking. During this pivotal movement of the cabinet about its vertical edge, a dispensing trigger plunger becomes withdrawn through a slot in the fixed faceplate. After restocking, the cabinet is closed, i.e., is returned to its original position, by pivoting the cabinet in the opposite direction about its vertical edge. During this closing movement, the plunger is required to reenter and pass through the slot in the fixed faceplate for return to its original projecting position. However, during both the opening of the cabinet when the plunger is withdrawn from the slot in the faceplate, and also during the closing of the cabinet when the plunger is reinserted into the slot, the plunger, being a component part of the pivoting cabinet, moves along an arcuate path due to the pivotal movement of the cabinet on its vertical edge hinge. The difficulty arises during the closing of the cabinet when the slot in the faceplate and the head of the plunger are both obscured from the view of the attendant. If the cabinet is not precisely aligned, the head of the plunger, instead of entering the slot, will strike the rear surface of the faceplate and the plunger will be broken.

SUMMARY OF THE INVENTION

An object of the present invention is to convert a front load vendor to a rear load vendor, and yet avoid the unsatisfactory plunger-breaking hazard described above. It is a further object of this invention to provide a design wherein the head of the plunger will enter and pass through a round hold in a fixed faceplate when the attendant closes the cabinet, thus avoiding the need to provide an elongated slot, and yet providing a design which avoids breaking the plunger.

The foregoing objects are achieved by purchasing a conventional front load cabinet minus the face plate and supporting the cabinet on a double pivoted hinge rather than on a single pivot hinge as is presently used. Instead of supporting the cabinet on a vertically disposed piano hinge, the cabinet, in accordance with the present invention, is supported on a vertical hinge rod having a pair of horizontal hinge arms, an upper arm and a lower arm, each of which extends horizontally from the vertical hinge rod. The cabinet is provided, at the center of the upper surface and also at the center of its lower surface, with a pivot post which is received within a hole in the outward end of the hinge arm. Thus, the cabinet is pivotal between the ends of the hinge arms. The cabinet, during the early portion of opening, and also during the final portion of closing, is movable by the attendant rearwardly and forwardly through a limited distance with the open face of the cabinet being maintained in a position substantially parallel to that of the fixed faceplate. As a result, the head of the trigger plunger during both withdrawal and reinsertion moves along a path which is substantially straight and coaxial relative to a round hole in the faceplate. By this action, the head of the plunger avoids striking the faceplate during the closing of the cabinet at a time when the plunger and the hole are obscured from the view of the attendant.

BRIEF DESCRIPTION OF THE DRAWINGS

FIG. 4(*a*) illustrates the pivotal movement of the left (as viewed from the rear) cabinet during opening of the cabinet for restocking.

FIG. 4(*b*) shows the cabinet of FIG. 4(*a*) after it has been fully pivoted to the restocking position with the open face of the cabinet facing rearwardly.

DETAILED DESCRIPTION OF THE PREFERRED EMBODIMENT

Figure 1:
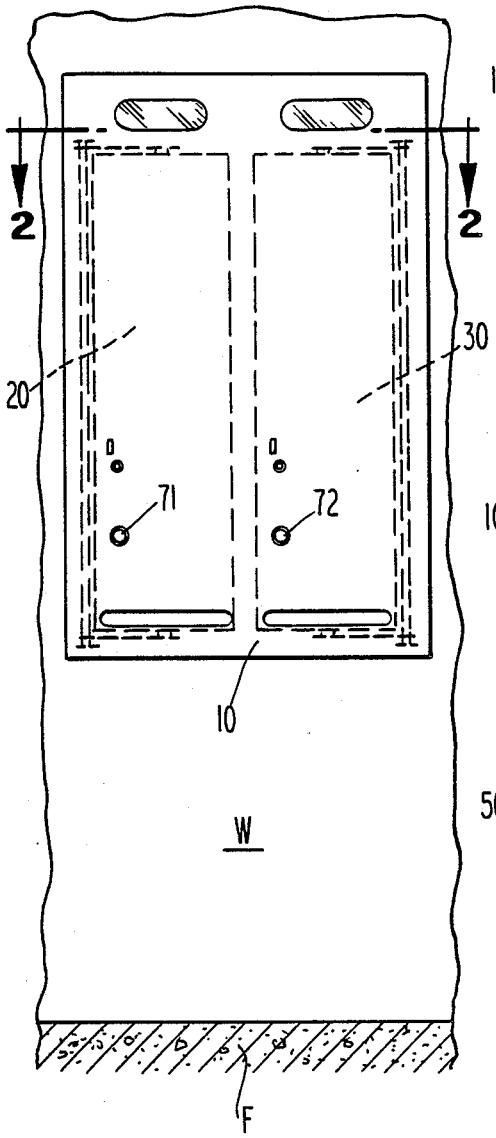
FIG. 1 is a front elevational view, illustrating a pair of rearload vendor cabinets embodying the present inventions mounted side-by-side on and behind a fixed faceplate.

In the drawing, two cabinets 20 and 30 of the rear load vendor type, are shown mounted side-by-side in an opening 11 in a wall W. The cabinets are shown mounted above the floor F at a convenient height for use by the customer. The opening 11 (FIG. 2) in the wall is covered by a fixed faceplate 10 having rearwardly extending side flanges 12 and 13 (FIG. 4) which are secured to the sidewall of the wall opening. Faceplate 10 also has a horizontal lower flange 14 (FIG. 2) and a horizontal upper flange 15. The cabinets 20 and 30 are supported in similar fashion. The support for cabinet 30 will be described in detail.

An elongated pivotal hinge rod 31 is verticaly disposed and pivotally supported at the bottom by a bracket 35 which, in turn, is secured as by welding on faceplate 10. The upper end of rod 31 is pivotaly supported in bracket 36 which is secured as by welding to faceplate 10. Secured, as by welding, to vertical hinge rod 31 are a pair of horizontal hinge arms 32 and 33, one at the upper end of rod 31 and the other at the lower end. The other end of each of the hinge arms 32,33 is provided with a hole adapted to receive one of the pivot posts 38, 39 located at the centers of the upper and lower surfaces of cabinet 30. The pivot posts 38, 39 are in vertical alignment and provide a second pivot axis, the first being the vertical axis of hinge rod 31. By the means just described, cabinet 30 is supported for pivotal movement about two axes, i.e., the axis of rod 31 and an imaginary vertical axis extending from upper pivot post 38 to lower pivot post 39. The length of the lateral hinge arms 32, 33 and the pivotal movement of the vertical hinge bar 31 permit the attendant to move cabinet 30 rearwardly such that the horizontal distance from the second pivot axis to the fixed faceplate 10 becomes greater than the horizontal distance from the second pivot axis to any point on the periphery of the cabinet. (See cabinet 30 in dot-and-dash lines in FIG. 4(*a*)). This allows the cabinet 30 to be pivoted through at least 180° on the second pivot axis, i.e., on the vertical axis of pivot posts 38, 39. The other cabinet 20 is mounted and supported in a manner similar to that just described for cabinet 30.

Figure 2:
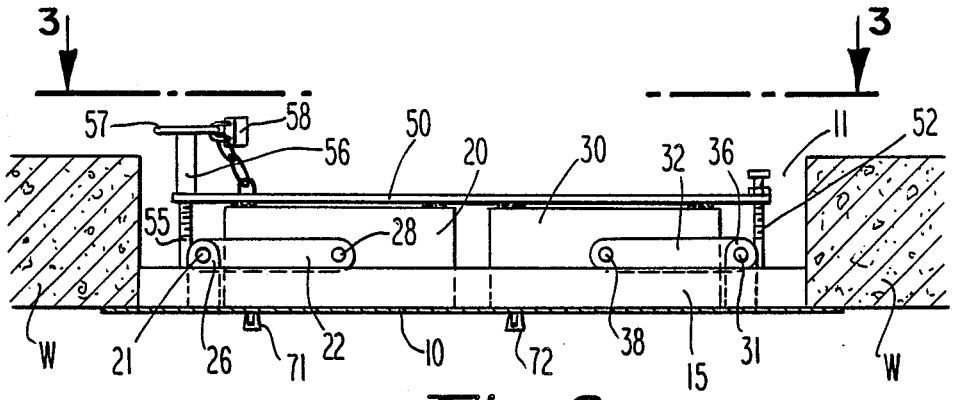
FIG. 2 is a top view looking down along the line 2—2 of FIG. 1.
Figure 3:
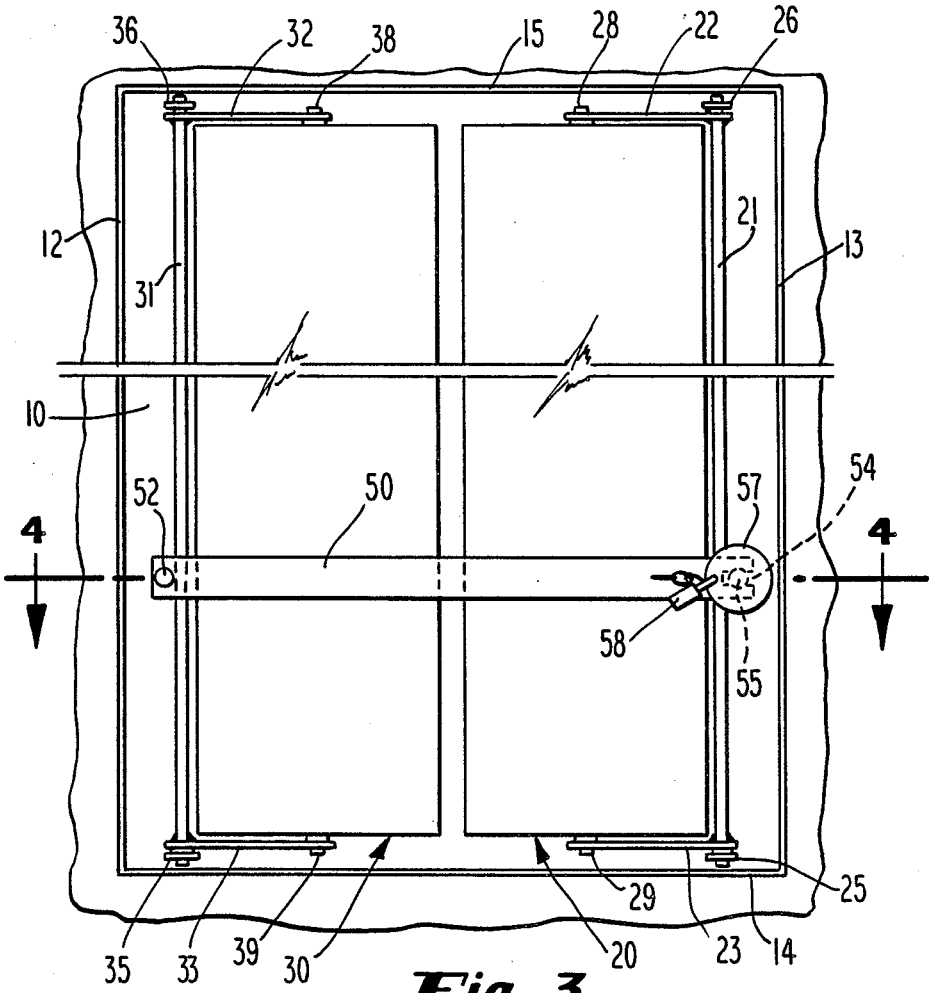
FIG. 3 is a rear elevational view of the cabinet of FIG. 1 looking along the lines 3—3 of FIG. 2.
Figure 4:
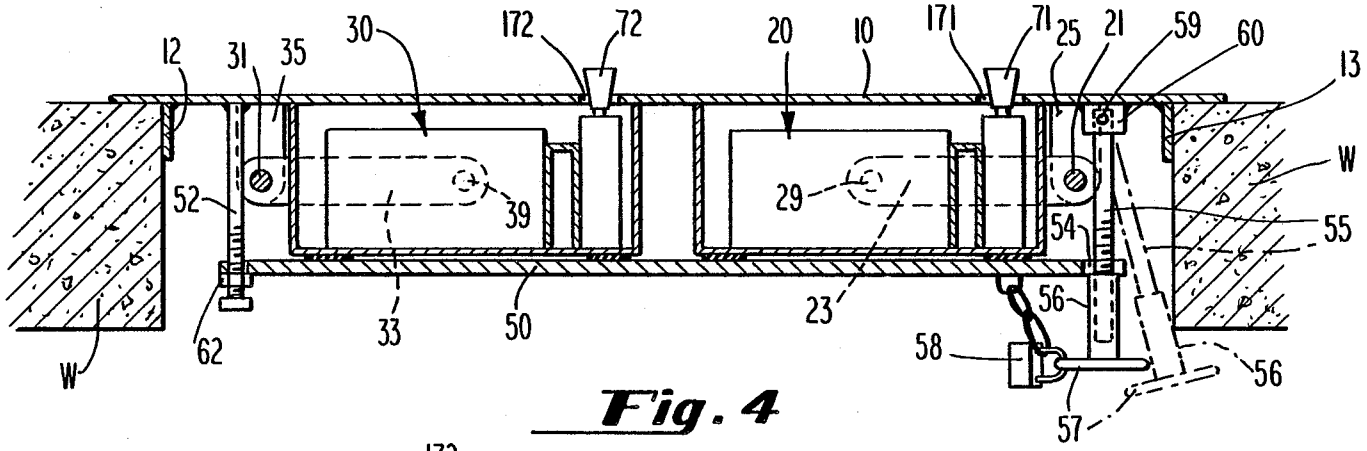
FIG. 4 is a view, in section, looking down along the lines 4—4 of FIG. 3.
Figure 4B:
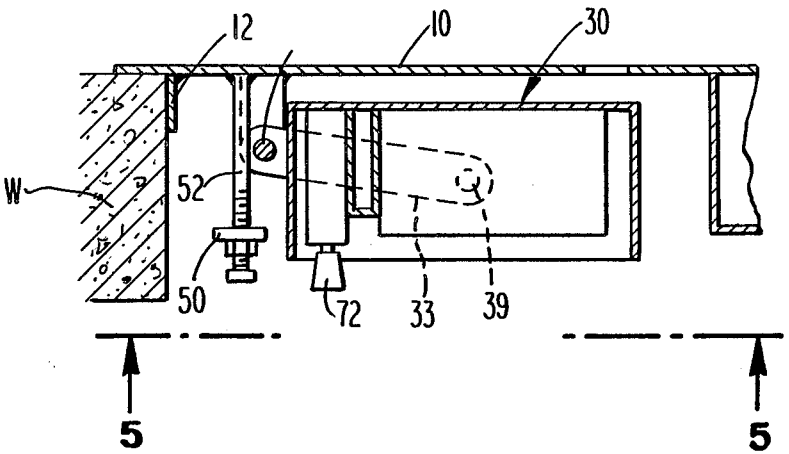
Figure 4A:
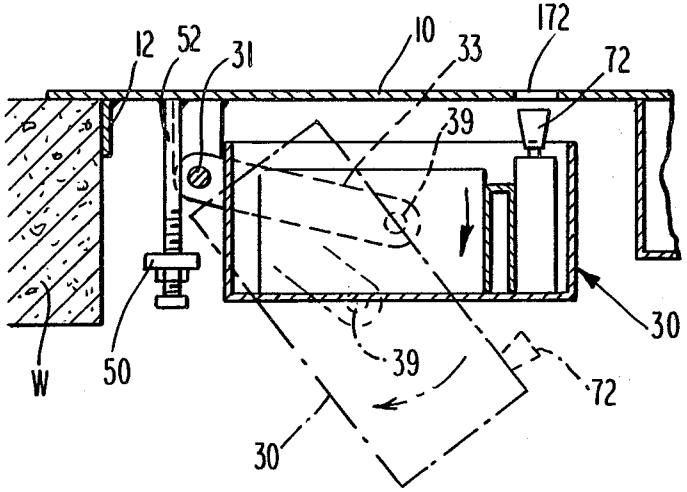

Extending across the rear of cabinets 20 and 30 is a retaining bar 50 (FIGS. 2–4). One end of bar 50, the end nearer to cabinet 30, is supported on a post 52 which extends rearwardly from faceplate 10 and is secured thereto as by welding. The rearward end of post 52 is threaded and receives a nut 62, which when tightened presses retainer bar 50 against the rear wall of cabinet 30. The other end of the retaining bar 50 is slotted as at 54. Slot 54 receives a post 55 which is mounted on a pivot hinge 59 which, in turn, is mounted on a bracket 60 secured as by welding to faceplate 10. The rearward end of post 55 is threaded and receives a cap 56 having a circular disk or wheel 57 at its outer end. When wheel 57 is rotated in a clockwise or tightening direction, retainer bar 50 is forced against the rear wall of cabinet 20 (FIG. 4).

It can be seen from FIG. 4 that when the retainer bar 50 presses against the rear walls of cabinets 20 and 30, the cabinets are in such position that the dispensing or trigger plungers 71, 72 project forwardly and outwardly through holes 171, 172 in the fixed faceplate 10. The positions shown in solid line in FIG. 4 represents the operating position of the cabinets 20 and 30. In this position, the customer pulls out and then pushes in one of the plungers 71, 72 to trigger the dispensing and discharge of the wanted product.

Figure 5:
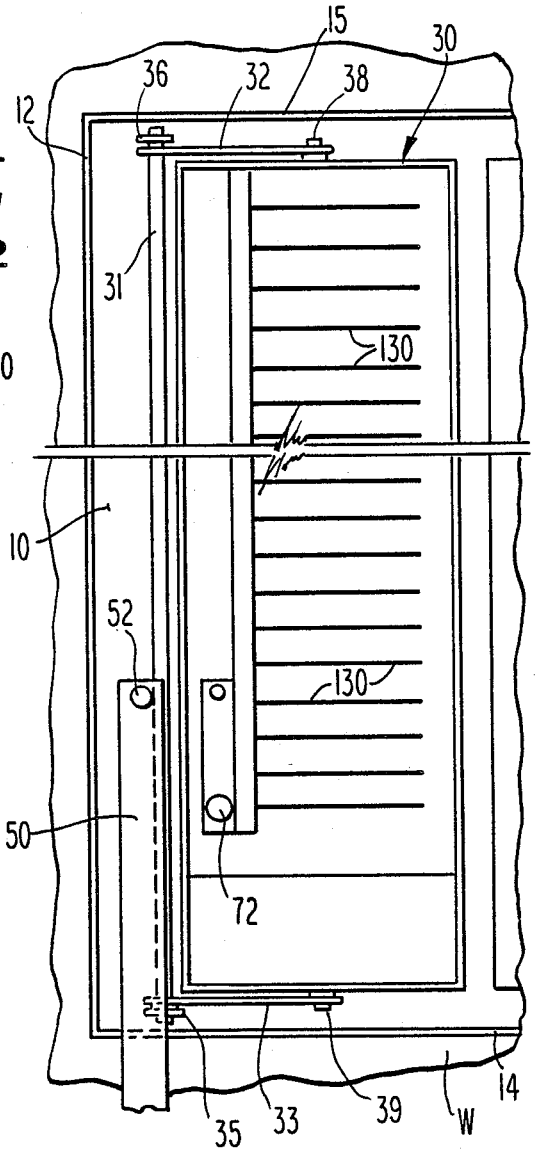
FIG. 5 is an elevational rear view of the cabinet looking along the line 5—5 of FIG. 4(B).

When the cabinets 20, 30 are to be restocked, the attendant, working at the rear of the cabinets, unlocks padlock 58 and removes it from wheel 57. This allows the attendant to rotate wheel 57 in a counterclockwise direction to move cap 56 outwardly or rearwardly, i.e., in a loosening direction. The attendant now moves post 55 pivotally from the position shown in solid line in FIG. 4 to the position shown in dot-and-dash. This releases the slotted end of the retainer bar 50 and allows he attendant to drop the bar 50 into a vertical position, as shown in FIG. 5, the non-slotted end of bar 50 pivoting about post 52. The cabinets 20 and 30 are now free to be moved.

Assume that the attendant plans to restock cabinet 30 first. He pulls cabinet 30 rearwardly, being careful to maintain the cabinet parallel with faceplate 10. This allows the head of plunger 72 to be withdrawn through its hole 172 in faceplate 10 along a path which is substantially straight, and coaxial with the axis of hole 172. The cabinet 30 is now in the position shown in solid line in FIG. 4(*a*). The attendant then swings the cabinet 30 pivotally about the second pivot axis, i.e., about the vertical axis of its upper and lower pivot posts 38, 39, into a position such as is illustrated in dot-and-dash in FIG. 4(*a*). The attendant continues pivotal movement of the cabinet 30 until the cabinet reaches the position shown in solid line in FIG. 4(*b*). In this position, the open face of cabinet 30 is facing - rearwardly, and as illustrated in FIG. 5, the shelves 130 of the cabinet may be easily restocked by the attendant. Following restocking, the attendant swings cabinet 30 pivotally in the opposite direction from that just described (counterclockwise as viewed in FIG. 4(*b*)) and returns the cabinet through the position shown in dot-and-dash in FIG. 4(*a*) to the position shown in the solid line in FIG. 4(*a*). When cabinet 30 is parallel with faceplate 10, i.e., is in the position shown in solid line FIG. 4(*a*), the attendant pushes the cabinet forward thereby causing the head of plunger 72 to pass through hole 172 into the position shown in FIG. 4. In moving toward and through hole 172, the head of plunger 72 moves along a substantially straight path and the probability of the head making contact with the faceplate 10 and of not entering the hole 172 is considerably lessened, as compared with the prior art mechanism in which the head of the plunger moves along an arcuate path having a relatively short radius.

What is claimed is:

1. Support means for a self-service rear load vendor intended to dispense packaged products from an open face of a pivotable cabinet when facing forwardly and to be restocked through said open face when facing rearwardly, said cabinet being supported on a fixed faceplate, said support means comprising:

a. a vertical hinge rod mounted on said face-plate for pivotal movement about its vertical axis, said rod forming a first pivot axis for said cabinet;

b. a pair of horizontal hinge arms secured to said hinge rod, one arm near the top and the other near the bottom, each hinge arm having a recess at its outward end; and c. a pair of pivot posts, one post secured to the top surface and another to the bottom surface of said cabinet, said pivot posts being located on a common vertical axis, each pivot post received within a recess in a hinge arm, said pivot posts forming a second pivot axis for said cabinet;

d. the horizontal length of each hinge arm and the pivotal movement of said hinge rod allowing said second pivot axis to be moved to a position such that the horizontal distance between said second pivot axis and said faceplate becomes greater than the horizontal distance between said second pivot axis and any point on the periphery of said cabinet, where said cabinet may be pivoted through at least 180° about said second pivot axis;

e. said cabinet having a forwardly projecting trigger plunger adapted to project through a hole in said fixed faceplate, the length of said horizontal hinge arms and the pivotal movement of said vertical hinge rod being such as to allow said cabinet to be moved rearwrdly and forwardly to allow withdrawal and reinsertion of said trigger plunger along a substantially straight line relative to said hole in said faceplate.

2. Support means for a self-service rear load vendor intended to dispense packaged products from an open face of a pivotable cabinet when facing forwardly and to be restocked through said open face when facing rearwardly, said cabinet being supported on a fixed faceplate, said support means comprising:

a. a vertical hinge rod mounted on said faceplate for pivotal movement about its vertical axis, said rod forming a first pivot axis for said cabinet;

b. a pair of horizontal hinge arms secured to said hinge rod, one arm near the top and the other near the bottom, each hinge arm having a pivot element at its outward end; and c. a pair of second pivot elements, one on the top surface and another on the bottom surface of said cabinet, said second pivot elements being located on a common vertical axis which forms a second pivot axis for said cabinet, said second pivot elements being cooperatively associated with the pivot element on the hinge arm;

d. the horizontal length of each hinge arm and the pivotal movement of said hinge rod allowing said second pivot axis to be moved to a position such that the horizontal distance between said second pivot axis and said faceplate becomes greater than the horizontal distance between said second pivot axis and any point on the periphery of said cabinet, whereby said cabinet may be pivoted through at least 180° about said second pivot axis;

e. said cabinet having a forwardly projecting trigger plunger adapted to project through a hole in said fixed faceplate, the length of said horizontal hinge arms and the pivotal movement of said vertical hinge rod being such as to allow said cabinet to be moved rearwardly and forwardly to allow withdrawal and reinsertion of said trigger plunger along a substantially straight line relative to said hole in said faceplate.

* * * * *